United States Patent [19]

Boggi et al.

[11] 4,400,825

[45] Aug. 23, 1983

[54] ADJUSTABLE SLIT RADIOGRAPHIC APPARATUS

[75] Inventors: John J. Boggi; Gerald V. Centrone, both of Williamstown; Aaron M. Dolin, Delran, all of N.J.; Ira N. Sherman, Cincinnati, Ohio

[73] Assignee: General Electric Co., Phila., Pa.

[21] Appl. No.: 35,863

[22] Filed: May 3, 1979

[51] Int. Cl.[3] ..... G21F 5/04

[52] U.S. Cl. ..... 378/150; 378/145

[58] Field of Search ..... 250/505, 511, 512, 513, 250/514

[56] References Cited

U.S. PATENT DOCUMENTS 2,511,853 6/1950 Kaiser ..... 250/323

3,849,649 11/1974 Carey ..... 250/511

OTHER PUBLICATIONS

"Investigations of Moving-Slit Radiography", Sorenson et al., Radiology, Sep. 1976, pp. 705-711.

*Primary Examiner*—Craig E. Church

*Attorney, Agent, or Firm*—Allen E. Amgott

[57] ABSTRACT

A system is provided for facilitating the use of an in-motion slit radiographic technique to inspect 3-dimensional composite materials. The system includes a lead lined device that is adjustable to form various slit shaped and size openings. When used in conjunction with a standard X-ray source and film, the device prevents the non-parallel and undesirable portion of the X-ray radiation from creating a distorted image when complex 3-dimensional structures are inspected.

4 Claims, 6 Drawing Figures

ADJUSTABLE SLIT RADIOGRAPHIC APPARATUS

BACKGROUND OF THE INVENTION

1. Field of the Invention

This invention relates to an in-motion, slit radiographic system and a method for non-destructive inspection of materials.

2. Description of the Prior Art

The extreme environment in which space vehicles operate creates tremendous demands on the materials used in the construction of those vehicles. As a result of such demands in recent years there has been extensive development and fabrication of advanced composite materials for re-entry vehicles and rocket nozzles. These composite materials are especially attractive because of improved strength to weight ratio, resistance to crack propagation, uniformity of ablation and ability to tailor the directional properties of the composite materials. In one form of such composite materials a 3-dimensional fibrous composite is produced by weaving or winding techniques followed by high pressure impregnation steps, and as a result, the weaved fiber parameters, such as spacing waviness and distortion, are very important to monitor and maintain. Due to the high cost of machining space vehicle parts from fibrous composite materials, it is very desirable to use non-destructive testing of the composite material to accurately determine the weave parameters and detect defects before machining of the part actually takes place.

One of the most useful of the non-destructive testing techniques is the use of radiography to obtain an X-ray image of the composite structure on radiographic film. Unfortunately, 3-dimensional composite materials present a new set of problems in the radiographic evaluation of structures, inasmuch as the chief concerns are weave geometry, spacing of fiber bundles, waviness, distortion and uniformity of density. As a result, 3-dimensional radiographic technique development has been concentrated on obtaining very defined X-ray images for evaluating the weave and impregnation.

Due to the highly oriented structure and fairly large cross-sections of these 3-dimensional composite materials, standard radiographic techniques display significant distortions due to the non-parallel rays of an X-ray beam emitted from an X-ray source. As a result, it is difficult to interpret the radiographs, because the non-parallel rays cause fuzziness and shadows on the radiograph.

One of the most popular and successful techniques currently used to eliminate the problems of non-parallel rays of X-ray radiation is what is known as slit radiography. Slit radiography refers to the use of a slit or opening in a shield to only allow a narrow beam of the radiation emitted from an X-ray source to impinge upon the object being tested. The rays within this narrow beam do not significantly diverge and are more nearly parallel to each other in comparison to the broad span of radiation emitted from an X-ray source. The shield prevents the widely diverging rays outside this narrow beam from impinging upon the object being tested. The use of slit radiography results in a relatively undistorted image of the object being tested, and is well known to those skilled in the art.

While the size of the slit used in slit radiography can be varied, generally, the use of a larger slit results in more diverging or non-parallel rays impinging on the object being tested and, therefore, a more distorted radiograph. Conversely, the use of a smaller slit size results in lessening the distortion of the radiograph. However, if a small slit size is used, many individual radiographs must be made in order to X-ray the entire object being tested. Development of X-ray film is time-consuming and expensive, and it is far more desirable to expose and develop a small number of radiographs as opposed to a large number.

The problem of developing multiple radiographs is resolved in the industry by what is known as in-motion slit radiography. Generally, with in-motion slit radiography, the X-ray film is attached to the object being tested, and the object itself is moved underneath the slit. The X-rays passing through this slit eventually strike the entire surface of the object when the motion is completed. A similar technique is to keep the object and the film stationary and move the X-ray source and the slit over the surface of the object being tested.

When in-motion radiography combined with slit radiography provides a reasonable useful and efficient method for X-raying composite structures, the large numbers of sizes and shapes of objects which must be tested create a need to devise numerous slit sizes, slit shapes and various types of motion in order to obtain satisfactory radiographs.

OBJECTS OF THE INVENTION

It is therefore an object of the present invention to provide an apparatus for in-motion slit radiography which provides a variety of sizes and shapes of slits to X-ray a variety of sizes and shapes of objects.

It is also an object of the present invention to provide a device for use with in-motion slit radiography in which the size and shape of the slit can be easily modified to fit the size and shape of the object being X-rayed, and to vary the accuracy and degree of definition of the radiograph.

It is also an object of the present invention to provide an apparatus for in-motion slit radiography in which cylindrical objects with various outer diameters can be easily and accurately X-rayed during rotational motion of the cylinder being X-rayed.

This and other objects of the invention will be pointed out hereinafter.

SUMMARY OF THE INVENTION

An adjustable slit system is provided for X-raying a variety of sizes and shapes of objects using in-motion slit radiographic techniques. The system employs a shielding structure which can be adjusted by simply sliding attached shields to various positions, thereby forming the desired slit size and shape configuration.

The shielding structure includes a lead-lined table mounted on four adjustable legs. Machined into the table is an opening or aperture comprising two basic shapes, i.e. a triangle and an attached rectangle with the base of the triangle coinciding with one side of the rectangle. A clam shell-shaped lead shield is mounted parallel to the table for rotation over the triangular opening to adjust the position of one leg of the triangle, and thereby change the angular size of the slit. The change in angular size is accomplished by changing the angle opposite the base of the triangle from 30° to 0°. A second shield is pivotally mounted parallel to the table and may be positioned to extend the second leg of the triangle across the rectangular opening. A third shield is slidably mounted to the table in a manner to slide laterally over the rectangular opening to change the size of the rectangular slit. The shields are adjustable to cover the portions of the appropriate openings not in use without changing or removing any of the permanent shielding from the table.

The provision of an adjustable or triangular-shaped slit permits one utilizing the apparatus to use the triangular shape for circular or cylindrical parts. The provision of an adjustable rectangular shaped slit permits one utilizing the apparatus to use the rectangular shape for square or rectangular parts. When circular or cylindrical parts are X-rayed, the radiographic film is first attached to the bottom surface of the object. The object is then placed on a rotating table positioned below the lead-lined platform so that the center of rotation is directly beneath the vertex angle opposite the base of the triangular-shaped slit. The object is then rotated with the center of the cylinder remaining directly beneath this vertex. During the rotation of the object through 360° of motion, the X-ray source is activated, thereby exposing the entire upper surface of the object, and thereby fully exposing the film attached to the bottom of the object.

When X-raying square shapes or irregular shapes, the rectangular opening in the lead-lined table is employed. Again, the film is attached to the bottom of the object being X-rayed. The rectangular shield is positioned over the rectangular opening to create the desired slit size. The object being X-rayed is then moved in a linear fashion underneath the rectangular slit to produce a radiograph.

BRIEF DESCRIPTION OF THE DRAWINGS

While the specification concludes with the claims particularly pointing out and distinctly claiming the subject matter of the invention, it is believed the invention will be better understood from the following description taken in conjunction with the accompanying drawings, wherein:

FIG. 3 is a plan view showing the subject invention adjusted for slit radiography of objects using linear motion;

FIG. 4 is a top view showing the subject invention adjusted for slit radiography of objects when using linear motion;

FIG. 5 is a plan view showing the subject invention adjusted for slit radiography of objects when using rotational motion; and FIG. 6 is a top view showing the subject invention adjusted for slit radiography of objects using rotational motion.

A summary description of the apparatus of the invention is first set forth and is followed by a description of the method of operation of the subject invention.

DESCRIPTION OF THE PREFERRED EMBODIMENT

Figure 1:
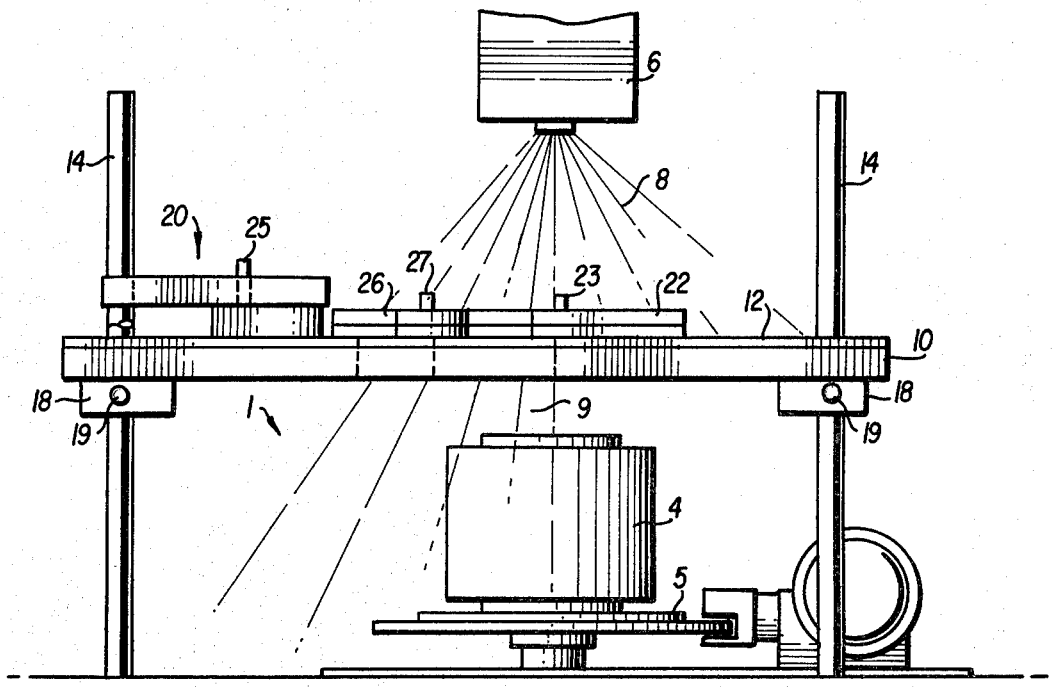
FIG. 1 is a plan view showing an object for inspection, an X-ray source and a shielding structure in accordance with the subject invention.

In accordance with this invention, there is included a shielding structure 1 that can be adjusted to provide various aperture or slit sizes and shapes for in-motion, slit radiography. As shown in FIG. 1, shielding structure 1, which is positioned directly over an object 4 to be X-rayed, includes a table 10, a lead lined platform 12 of suitable thickness attached to the top of table 10, and means 20 for forming an adjustable slit within table 10 and platform 12 to conveniently vertically position the formed slit over the object to be examined. A standard X-ray source 6 is positioned over the shielding structure.

When X-ray exposure takes place, X-ray source 6 is activated, and a widely diverging cone of X-rays 8 emanate from X-ray source 6. The purpose of the apparatus of this invention, which includes the new and useful slit adjusting shielding structure, is to prevent all but a narrow beam 9 of X-rays from passing through shielding structure 1 and impinging upon object 4 to which a radiographic film 5 is attached at the underside thereof. While the narrow beam only strikes a small portion of the surface of object 4, the entire surface is eventually exposed by moving the object underneath the slit formed in the shielding structure. When movement of the object has been completed, an X-ray image of the object is left on the film. During the exposure period, the shielding structure prevents the diverging non-parallel portion of X-rays 8 from striking and passing through the object and distorting the image of the object formed on the radiographic film. Table 10 and platform 12 are provided with four holes 16 (shown in FIG. 2), through which four respective legs 14 are inserted. The table and platform slide up and down along the legs and can be adjusted for height. The height adjustment is desirable so that the slit can be positioned as close as possible to the top of the object being X-rayed during the X-ray procedure. This minimizes any distortion caused by stray or diverging X-rays striking the radiographic film. Four blocks 18 (only two are shown in FIG. 1) are attached to the platform at each of the four corners directly below each hole. Set screws 19 are threadably inserted into each block. The screws can be tightened to engage legs 14 and hold table 10 in position on the legs after the platform has been properly adjusted for height.

Figure 2:
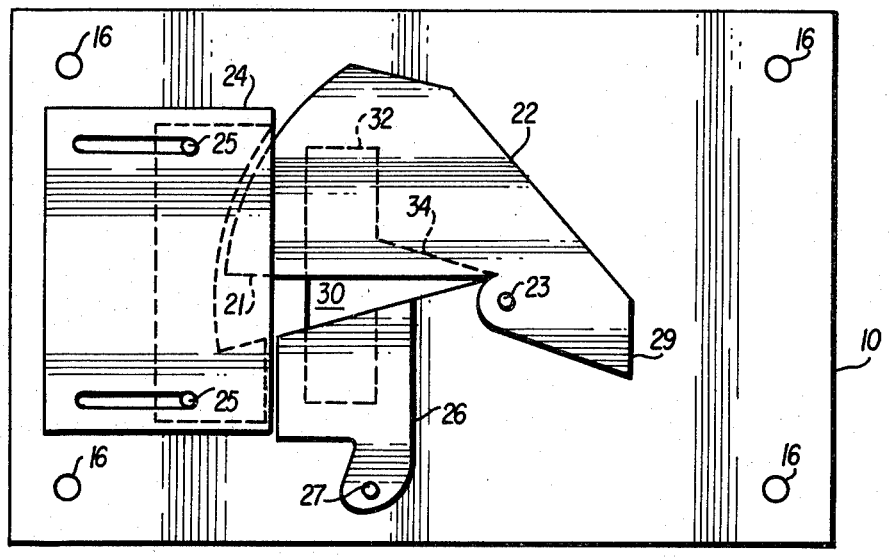
FIG. 2 is a top view showing the shielding structure of the subject invention.

Referring now to FIG. 2, adjustable slit means 20 is uniquely constructed to include shields 22, 24, and 26 mounted on respective pivot points or posts 23, 25, and 27, which shields can be adjusted to provide the desired slit shape and size without removing any of the shields from platform 12. The shields, of course, are at least lead lined to block the penetration of X-ray radiation therethrough. These shields slide along the platform to assume various configurations which expose varying portions of an opening 30 extending completely through platform 12 and table 10.

Opening 30 in the platform is in the form of a rectangular portion 32 and an adjacent triangular portion 34, wherein the base of the triangle is coincident with one side of the rectangle. As indicated before, the remaining surface area of platform 12 is lead lined so that X-ray radiation can only pass through the unshielded opening in the platform.

The three shields of the adjustable slit device are mounted adjacent opening 30 in platform 12. Shield 22 is clam shell-shaped, and has two sections 21 and 29 which rotate about a pin at pivot-point 23. Clam shell-shaped shield 22 can be rotated to expose varying amounts of triangular partion 34 in the platform. As section 21 of clam shell-shaped shield 22 is rotated over the triangular opening, the shield continuously changes the size of the triangular opening, with a scissors-like action, by changing the position of one leg of the triangle. As the scissors action progresses, the angle opposite the base of the triangle changes from 30° to 0°. When the triangular-shaped opening is being used, shield 26 is rotated about a post at pivot point 27 to the position shown in FIG. 2 in order to form an extension of one leg of the triangle across the rectangular portion of opening 30. In this manner, a triangular slit of substantial height can be formed.

In order to adjust the position of the base and therefore the height of the triangle, third shield 24, which is rectangular in shape, is slidably mounted along two posts 25. This shield can be moved laterally along the platform to adjustably determine the base of the triangular opening. In FIG. 6, third shield 24 has been moved laterally to decrease the height of the triangular-shaped opening.

When a rectangular-shaped slit is desired, second shield 26 is rotated as shown in FIG. 4 to fully expose the bottom part of rectangular portion 32. Similarly, as shown in FIG. 4, shield 22 is rotated to completely expose the entire upper part of the rectangular portion of opening 30, while second section 29 of shield 22 covers triangular portion 34 of opening 30, thereby forming part of the border of one side of rectangular portion 32. If it is desirable to adjust the width of rectangular portion 32, rectangular shield 24 can be adjusted laterally to expose varying widths of the rectangular portion.

Referring now to FIGS. 3 and 4, the invention is shown with the shields adjusted to expose rectangular portion 32 of opening 30 for X-raying objects presenting a rectangular-shaped outline to the X-ray source and the radiographic film. A linear actuator 40 is positioned below the table, and X-ray source 6 (shown in FIG. 1) is positioned above the slit in the table. An object 2 to be X-rayed is placed on the linear actuator such that the linear actuator will move the object underneath the platform to allow X-rays passing through the rectangular slit to expose the entire length of the object during its movement under the slit. Radiographic film is attached to the bottom of the object, and the film is progressively exposed in the same fashion as the object itself. The linear actuator operates at a constant speed. Therefore, all points on the upper surface of the object receives equal amounts of radiation, and the film is uniformly exposed. After the object has completely passed beneath the slit, the radiographic film is fully exposed and ready for development.

Referring now to FIGS. 5 and 6, the invention is shown with the shields adjusted to expose triangular portion 34 of opening 30 for X-raying an object presenting a circular outline to the X-ray source and the radiographic film. In FIGS. 5 and 6 an object 3 is a cylinder. First, the shields comprising the adjustable slit mechanism are positioned to provide the desired radiation through the triangular-shaped slit in the platform. Radiographic film 5 is attached to the bottom of the cylinder. A mechanical rotating table 50, such as is well known in the art, is positioned below the slit in the platform. Cylinder 3 is then placed on the rotating table 50 so that the center of the cylinder is directly over the center of rotation of the rotating table. The rotating table is then positioned below the triangular slit so its center of rotation is directly beneath the vertex of the adjusted angle of the triangular slit. The height of platform 12 is adjusted to a position just over the cylindrical object 3. The rotating table shown in FIG. 5 is turned on, and the cylinder begins to rotate. When the X-ray source is activated, a pie-shaped segment of upper surface of the cylinder is exposed to the X-rays passing through the triangular slit. The X-ray source remains activated for the proper length of time to expose the full 360° of the upper surface of the cylinder during rotation of the object. The radiographic film is then fully exposed and is ready for development.

Although this invention has been described with reference to a specific embodiment thereof, numerous modifications are possible without departing from the invention, and it is desirable to cover all modifications falling within the spirit and scope of this invention.

What we claim as new and desire to secure by Letters Patent of the United States is:

1. An apparatus for proving in-motion slit radiography of objects of varying sizes and shapes, comprising:

an X-ray source;

an X-ray shielding structure positioned between said X-ray source and an object to be X-rayed;

said shielding structure including a platform forming a barrier to X-ray radiation and having an opening extending through said platform for passing therethrough radiation from said X-ray source to the object;

said opening having a triangular shaped portion, and a rectangular portion having one side coincident with the base of said triangular portion;

X-ray film positioned so that the object to be X-rayed is between said X-ray source and said film;

means for adjusting said opening in said structure to expose a portion of a surface of the object to substantially parallel beams of radiation at any one moment;

said means for adjusting said opening including a first pivotally mounted X-ray radiation shield attached to said platform for movement to a first position over said opening to adjust the size of a triangular slit formed thereby; and means for moving the object relative to said X-ray source to cumulatively expose the entire surface of the object and said film to radiation from said X-ray source.

2. An apparatus for providing in-motion slit radiography according to claim 1, wherein said means for adjusting said opening further includes a second pivotally mounted X-ray radiation shield attached to said platform for movement over said rectangular portion to extend the border of one leg of said triangular slit into said rectangular portion of said opening.

3. An apparatus for providing in-motion slit radiography according to claim 2, wherein said means for adjusting said opening further includes a third X-ray radiation shield mounted on said platform for linear movement across said rectangular portion of said opening for adjusting the width of a rectangular slit formed thereby or for adjusting the position of the base of said triangular shaped slit.

4. An apparatus for providing in-motion slit radiography according to claim 3, wherein said first shield includes a part which moves to cover said triangular portion and form a straight side bordering said rectangular slit.

* * * * *